United States Patent [19]

Laine

[11] Patent Number: 4,542,524

[45] Date of Patent: Sep. 17, 1985

[54] MODEL AND FILTER CIRCUIT FOR MODELING AN ACOUSTIC SOUND CHANNEL, USES OF THE MODEL, AND SPEECH SYNTHESIZER APPLYING THE MODEL

[75] Inventor: Unto Laine, Tampere, Finland

[73] Assignee: Euroka Oy, Finland

[21] Appl. No.: 413,342

[22] PCT Filed: Dec. 15, 1981

[86] PCT No.: PCT/FI81/00091

§ 371 Date: Aug. 11, 1982

§ 102(e) Date: Aug. 11, 1982

[87] PCT Pub. No.: WO82/02109

PCT Pub. Date: Jun. 24, 1982

[30] Foreign Application Priority Data

Dec. 16, 1980 [FI] Finland ..... 803928

[51] Int. Cl.[4] ..... G10L 1/00

[52] U.S. Cl. ..... 381/53; 333/118

[58] Field of Search ..... 381/51–53; 364/513, 513.5; 333/168

[56] References Cited

PUBLICATIONS

J. Flanagan, *Speech Analysis, Synthesis, Perception,* McGraw-Hill, 2nd Ed., 1972, pp. 223–228.

Behaviour Research Method and Instrumentation, vol. 8, No. 2, Apr. 1976, (Austin, US), D. W. Massaro: "Real-Time Speech Synthesis", pp. 189–196, see in particular pp. 190, 191: The Synthesizer.

Journal of the Acoustical Society of America, vol. 61, Suppl. No. 1, Spring 1977, (New York, US), D. H. Klatt: "Cascade/Parallel Terminal Analog Speech Synthesizer and a Strategy for Consonant-Vowel Synthesis", p. S68, see abstract 114.

ICASSP 80, Proceedings of the IEEE International Conference on Acoustics, Speech and Signal Processing, Apr. 9–11, 1980, Denver, IEEE (New York, US), vol. 3, J. L. Caldwell: "Programmable Synthesis Using a New Speech Microprocessor", pp. 868–871, see in particular Hardware Operation.

1971 IEEE International Convention Digent, published by The Institute of Electrical and Electronics Engineers, Inc., (New York, US), Y. Kato et al.: "A Terminal Analog Speech Synthesizer in a Small Computer", pp. 102, 103, see in particular figure 1.

*Primary Examiner*—E. S. Matt Kemeny

*Attorney, Agent, or Firm*—Steinberg & Raskin

[57] ABSTRACT

Speech and music phonation formed by spectral formants is synthesized by a composite filter containing parallel filters in cascade. The composite filter design is generated by partial-function expansion of the approximate sound channel transfer function $$H(w) = \frac{A}{\cos Kw + ja \sin Kw}$$

and the composite filter is implemented with mutually adjacent formants in cascade filter elements.

11 Claims, 19 Drawing Figures

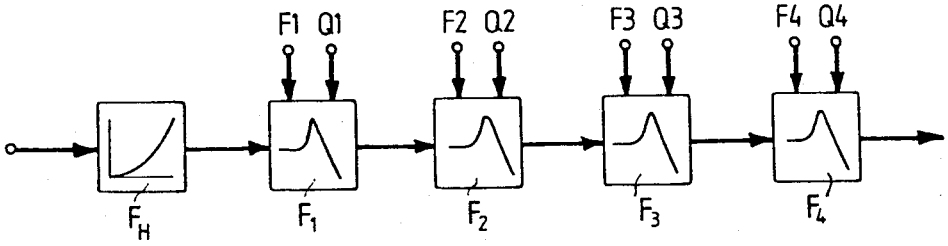
FIG. 1A Cascaded Model (Prior Art)
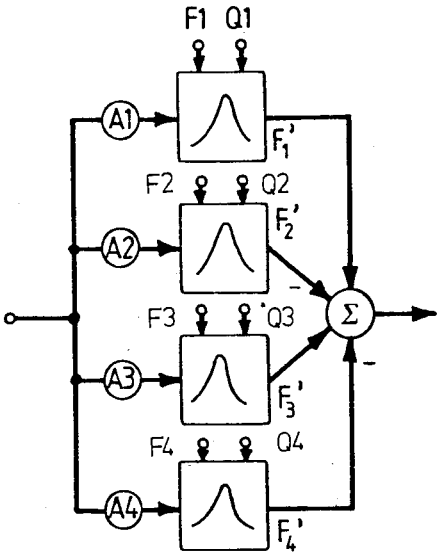
FIG. 1B Parallel Model (Prior Art)
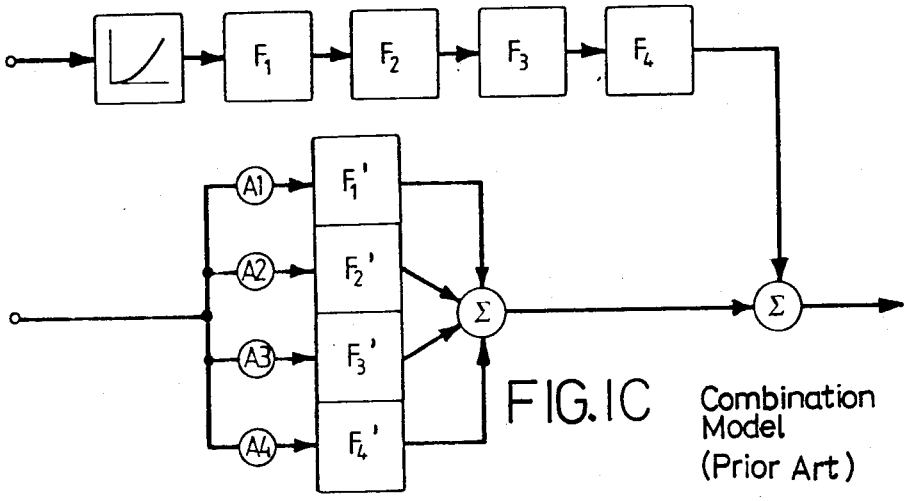
FIG. 1C Combination Model (Prior Art)

MODEL AND FILTER CIRCUIT FOR MODELING AN ACOUSTIC SOUND CHANNEL, USES OF THE MODEL, AND SPEECH SYNTHESIZER APPLYING THE MODEL

BACKGROUND OF THE INVENTION

The present invention concerns a model of the acoustic sound channel associated with the human phonation system and/or music instruments and which has been realized by means of an electrical filter system.

Furthermore, the invention concerns new types of applications of models according to the invention, and a speech synthesizer applying models according to the invention.

The invention also concerns a filter circuit for the modelling of an acoustic sound channel.

In its most typical form, this invention is associated with speech synthesis and with the artificial producing of speech by electronic methods.

One object of the invention is to create a new model for modelling e.g. the acoustic characteristics of the human speech mechanism, or the producing of speech. Models produced by the method may also be used in speech recognition, in estimating the parameters of a genuine speech signal and in so-called Vocoder apparatus, in which speech messages are transferred with the aid of speech signal analysis and synthesis with a minor amount of information e.g. over a low information rate channel, at the same time endeavouring to maintain the highest possible level of speech quality and intelligibility.

Since the model of the invention is intended to be suitable for the modelling of events taking place in an acoustic tube in general, the invention is also applicable to electronic music synthesizers.

The methods of prior art serving the artificial producing of speech are divisible into two main groups. By the methods of the first group only such speech messages can be produced which have at some earlier time been analyzed, encoded and recorded from corresponding genuine speech productions. Best known among these procedures are PCM (Pulse Code Modulation), DPCM (Differential Pulse Code Modulation), DM (Delta Modulation) and ADPCM (Adaptive Differential Pulse Code Modulation). A feature common to these methods of prior art is that they are closely associated with signal theory and with the general signal processing methods worked out on its basis and therefore imply no detailed knowledge of the character or mode of generation of the speech signal.

The second group consists of those methods of prior art in which no genuine speech signal has been recorded, neither as such or in coded form, instead of which the speech is generated by the aid of apparatus modelling the functions of the human speech mechanism. First, from genuine speech are analyzed its recurrent and comparatively invariant elements, phonetic units or phonemes and variants thereof, or phoneme variants, in varying phonetic environments. In the speech synthesizing step, the electronic counterpart of the human speech system, which is referred to as a terminal analog, is so controlled that phonemes and combinations of phonemes equivalent to genuine speech can be formed. To date, these are the only methods by which it has been possible to produce synthetic speech from unrestricted text.

In the territory between the said two groups of methods of prior art is located Linear Predictive Coding, LPC, /1/ J. D. Markel, A. H. Gray Jr.: Linear Prediction of Speech, New York, Springer-Verlag 1976. Differing from other coding methods, this procedure necessitates utilization of a model of speech producing. The starting assumption in linear prediction is that the speech signal is produced by a linear system, to its input being supplied a regular succession of pulses for sonant and a random succession of pulses for unvoiced speech sounds. It is usual to employ as transfer function to be identified, an all-pole model (cf. cascade model). With the aid of speech signal analysis, estimates are calculable for the coefficients ($a_i$) in the denominator polynomial of the transfer function. The higher the degree of this polynomial (which is also the degree of the prediction), the higher is the precision with which the speech signal can be provided with the aid of the coefficient $a_i$.

The filter coefficients $a_i$ are however nonperspicuous from the phonetic point of view. To realize a digital filter using these coefficients is also problematic, for instance in view of the filter hardware structures and of stability considerations. It is partly owing to these reasons that one has begun in linear predicting to use a lattice filter having a corresponding transfer function but provided with a different inner structure and using coefficients of different type.

In a lattice filter of prior art, bidirectionally acting and structurally identical elements are connected in cascade. With certain preconditions, this filter type can be made to correspond to the transfer line model of a sound channel composed of homogeneous tubes with equal length. The filter coefficients $b_i$ will then correspond to the coefficients of reflection ($|b_i|<1$). The coefficients $b_i$ are determinable from the speech signal by means of the so-called PARCOR (Partial Correlation) method. Even though the coefficients of reflection $b_i$ are more closely associated with speech production, i.e., with the articulatory aspect, generation of these coefficients by regular synthesis principles has also turned out to be difficult.

It is thus understood that speech synthesis apparatus of the terminal analog type, known in prior art, implies that speech production is modelled starting out from an acoustic-phonetic basis. For the acoustic phonation system, consisting of larynx, pharynx and oral and nasal cavities, an electronic counterpart has to be found of which the transfer function conforms to the transfer function of the acoustic system in all and any enunciating situations. Such a time-variant filter is referred to as a terminal analog because its overall transfer function from input to output, or between the terminals, aims at analogy with the corresponding acoustic transfer function of the human phonation system. The central component of the terminal analog is called the sound channel model. As known, this is in use e.g. in vowel sounds and partly also when synthesizing other sounds, depending on the type of model that is being used.

Since the human phonation system is extremely complex of its acoustical properties, a number of simplifications and approximations must be made when formulating models for practical applications. A problem of principle which figures centrally in such model formulation is that the sound channel is a subdivided system with an acoustic transfer function composed of transcendental functions. Creation of a corresponding terminal analog arrangement using lumped electrical components requires that the acoustic transfer function can be approximated with the aid of rational, meromorphic functions.

Another centrally important point is the controllability of the model, that is the number and type of control parameters required in the model to the purpose of creating speech, and the degree in which the group of control parameters meets the requirements of optimal, "orthogonal" and phonetically clear-cut selection.

As known in the prior art, in constructing sound channel models, the acoustic sound channel is simplified by assuming it to be a straight homogeneous tube, and for this the transfer line equations are calculated (cf. /2/ G. Fant: Acoustic Theory of Speech Production, the Hague, Mouton 1970, Chapters 1.2 and 1.3; and /3/ J. L. Flanagan: Speech Analysis Synthesis and Perception, Berlin, Springer-Verlag 1972, p. 214–228). The assumption is made that the tube has low losses and is closed at one end; the glottis, or the opening between the vocal cords, closed; and the other end opening into the free field. The acoustic load at the mouth opening may be simply modelled either by a short circuit or by a finite impedance $Z_r$. The acoustic transfer function that is being approximated will then have the form:

$$H_A(s) = \frac{1}{\cosh y(s)l + \frac{Z_r}{Z_o}\sinh y(s)l} \quad (1)$$

where $y(s) = \alpha + j\beta$ = propagation coefficient $\alpha$ = attenuation factor $\beta = \omega/c$ = phase factor $\omega$ = angular frequency c = velocity of sound $Z_r$ = radiation load impedance $Z_o$ = characteristic impedance of the channel l = length of the channel.

Assuming that the losses of the channel are minor and that the channel terminates in short circuit ($Z_r = 0$), or that the channel is lossless and $Z_r$ is resistive, Equation (1) becomes:

$$H_A(\omega) = \frac{A}{\cos k\omega + j\,a \sin k\omega} \quad (2)$$

where A, a and k are real. The logarithmic amplitude graph of the absolute value of the transfer function $H_A(\omega)$ is shown in FIG. 7. The homogeneous sound channel chosen as starting point for the approximation is most nearly equivalent to the situation encountered when pronouncing a neutral vowel ($\omega$). The profile of the sound channel and its transfer function are altered for other vowel sounds.

SUMMARY OF THE INVENTION

The basic idea of estimation theories is that these exists an a-priori model of the system which is to be estimated. The principle of estimation is that when a similar signal as to the system which is to be identified is input to the model, the output from the model can be made to conform to the output signal of the system to be identified, the better the greater the accuracy with which the model parameters correspond to the system under analysis. Therefore it is clear that the results of estimation obtainable with the aid of the model increase in reliability with increasing conformity of the model used in estimation of the system that is being identified.

The object of the present invention is to provide a new kind of method for the modelling of speech production. It is possible by applying the method of the invention to create a plurality of terminal analogs which are structurally different from each other. The internal organization of the models obtainable by the method of the invention may vary from pure cascade connection to pure parallel connection, also including intermediate forms of these, or so-called mixed type models. In all configurations, however, the method of the invention furnishes an unambiguous instruction as to how the transfer function of the individual transfer function should be for achievement of the best approximation in view of Equation (2).

The general object of the present invention is to attain the objects set forth above and to avoid the drawbacks that have been discussed. To this end, in the model of the invention, the transfer function of the electrical filter system is substantially consistent with an acoustic transfer function modelling the sound channel which has been approximated by decomposing said transfer function by mathematical means into partial transfer functions with simpler spectral structure. Each of the partial transfer functions has been approximated, each one separately, by realizable rational transfer functions. An electronic filter in the electrical filter system separately corresponds to each rational transfer function. The filters are mutually connected in parallel and/or series for the purpose of obtaining a model of the acoustic sound channel.

A further object of the invention is the use of channel models according to the invention in speech analysis and recognition, the use of channel models according to the invention as estimation models in estimating the parameters of a speech signal, and the use of the transfer function representing a single, ideal acoustic resonance, obtainable by repeated use of Equation (6) to be presented later on, in speech signal analysis, parametration and speech recognition.

A further object of the invention is to provide a speech synthesizer comprising input means, a microcomputer, a pulse generator and noise generator, a sound channel model and means by which the electrical signals are converted into acoustic signals. In this synthesizer, the input means is used to supply to the microcomputer the text to be synthesized. The coded text transmitted by the input means is in the form of series or parallel mode signals through the microcomputer's intake circuits to its temporary memory. The arithmetic-logical unit of the microcomputer operates in a manner prescribed by the program stored in a permanent memory. In the speech synthesizer, the microcomputer read the input text from the intake circuits and store it in the temporary memory. In the speech synthesizer, after completion of the storing of the symbol string to be synthesized, a control synthesis program is started, which analyzes the stored text and with the aid of tables and sets of rules forms the control signals for the terminal analog, which consists of the pulse and noise generator and the sound channel model. The principal feature of the above-defined speech synthesizer of the invention is that a parallel-series model according to the invention serves as sound channel model in the speech synthesizer.

The invention differs from equivalent methods and models of prior art substantially in that the acoustic transfer function having the form (2) is not approximated as one whole entity, but it is instead first decomposed by exact procedures into partial transfer functions having a simpler spectral structure. The actual approximation is only performed after this step. Proceeding in this way, the method minimizes the approximation error, whereby the transfer functions of the models obtained are no longer in need of any correction factors, not even in inhomogeneous cases.

The most appropriate range of application of the method of the invention of which the inventor is aware is found in the implementation of mixed type models. In the description of the mixed type models of the invention, which are of a certain kind of parallel cascade models, the name PARCAS model is used, this being derived from the word combination Parallel+Cascade.

The PARCAS models of the invention are realizable by means of structurally simple filters. In spite of their simplicity, the models of the invention afford a better correspondence and accuracy than heretofore in the modelling of the acoustic phenomena in the human phonation system. In the invention, one and the same structure is able to model effectively all phenomena associated with human speech, without any remarkable complement of external additional filters or equivalent ancillary structures. The group of control parameters which the PARCAS models require is comparatively compact and orthogonal. All parameters are acoustically-phonetically relevant and easy to generate by regular synthesis principles.

As taught by the invention, the PARCAS models combine the advantages of the series and parallel models, while the drawbacks are eliminated in many aspects.

The model of the invention gives detailed instructions as to the required type, for example, of the individual formant circuits F1 . . . F4 used in the model of FIG. 1 regarding their filter characteristics to ensure that the overall transfer function of the model approximates as closely as possible the acoustic transfer function of Equation (2). The procedure of the invention is expressly based on decomposition of Equation (2) into simpler partial transfer functions which have fewer resonances, compared with the original transfer function, within the frequency band under consideration. The decomposition into partial transfer functions can be done fully exactly in the case of a homogeneous sound channel. The next step in the procedure consists of approximation of the partial transfer functions, for example, by second order filters.

BRIEF DESCRIPTION OF THE DRAWINGS

For a fuller understanding of the invention, reference is had to the following description, taken in connection with the accompanying drawings, in which:

FIG. 1A shows a series (cascade) model known in the prior art;

FIG. 1B shows a parallel model known in the prior art;

FIG. 1C. shows a combined model known in the prior art;

DESCRIPTION OF PREFERRED EMBODIMENTS

Figure 1D:
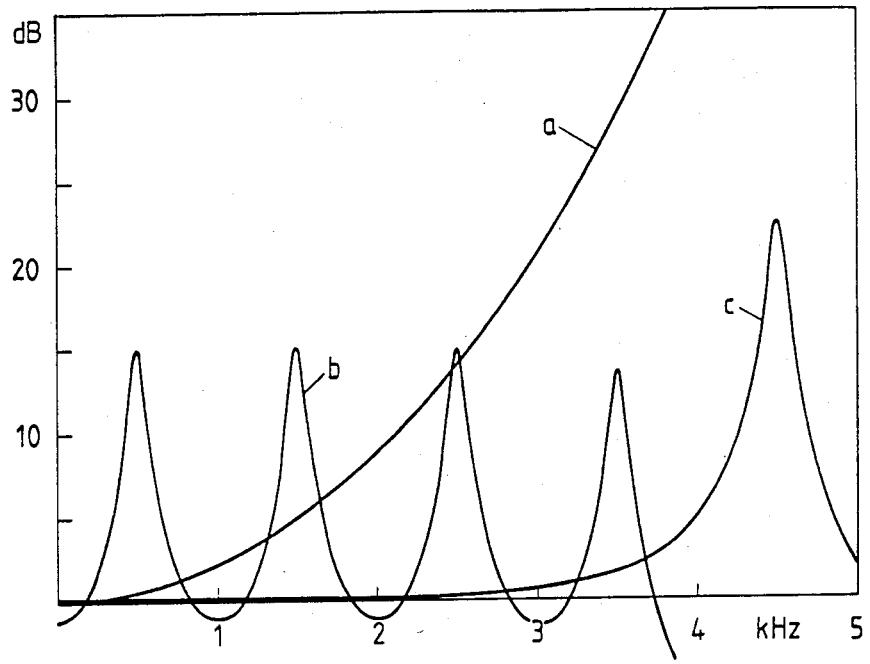
FIGS. 1D, 1E and 1F show, with a view to illustrating the problems constituting the starting point of the present invention, the graphic result of computer simulation.

The method commonly known in the prior art for approximation by rational functions of the idealized acoustic transfer function $H_A(\omega)$ is to construct an electronic filter out of second order low-pass or band-pass filter elements with resonance. Most commonly used are the cascade circuit of low-pass filters, depicted in FIG. 1A, and the parallel circuit of band-pass filters, shown as a block diagram in FIG. 1B.

If in an acoustic channel when the channel profile changes its adjacent resonances approach each other, this causes the signal components in their ambience to be amplified, similarly as occurs in series-connected electronic resonance circuits. As a result, the cascade model (FIG. 1A) of prior art is more advantageous than the parallel model (FIG. 1B). In order that the amplitude proportions of the resonances (or formants) might arrange themselves as desired, it is necessary in the parallel model to adjust each amplitude separately (coefficients A1–A4 in FIG. 1B). In the cascade model, the amplitude relations automatically adjust themselves to be approximately correct, and separate adjustments are not absolutely needed. It is true, though, that in this model too, considerable errors are incurred in the formants' amplitude proportions in certain circumstances, as will be shown hereinafter.

With a view to synthesis of consonant sounds on the other hand the parallel model is more favorable than the cascade model. By reason of its separate amplitude adjustments its transfer function can always be made to conform fairly well to the acoustic transfer function. Synthesis of consonant sounds is not successful with the cascade model without additional circuits connected in parallel and/or series with the channel. A further problem with the cascade model is that the optimum signal/-noise ratio is hard to achieve. The signal must be alternatingly derivated and integrated, and this involves increased noise and disturbances at the upper frequencies. Due to this fundamental property, the model is also non-optimal with a view to digital realizations. The computing accuracy required by this model is higher than in the parallel-connected model.

FIG. 1C shows a fairly recent problem solution of the prior art, the so-called Klatt model, which tries to combine the good points of the parallel and series-connected models /4/ J. Allen, R. Carlson, B. Granstrom, S. Hunnicutt, D. Klatt, D. Pisoni: Conversion of Unrestricted English Text to Speech, Massachusetts Institute of Technology 1979. This combination model of prior art requires the same group of control parameters as the parallel model. The cascade branch F1–F4 is mainly used for synthesis of voiced sounds and the parallel branch F1'-F4' for that of fricatives and transients (unvoiced sounds). The English speech synthesized with this combination model represents perhaps the highest quality standard achieved to date with regular synthesis of prior art. An obstacle hampering the practical applications of the combination model is the complexity of its structural embodiment. The combination model requires twice the group of formant circuits compared with equivalent cascade and parallel models. Even though the circuits in different branches of the combination associated with the same formants are controllable by the same variables (frequency, Q values), the complex structure impedes the digital as well as analog realizations.

Approximation of the acoustic transfer function with the parallel model is simple in principle. The resonance frequencies F1 . . . F4 and Q values Q1 . . . Q4 of the band-pass filters are adjusted to conform to the values of the acoustic transfer function, the filter outputs are summed with such phasing that no zeroes are produced in the transfer function, and the final step is to adjust the amplitude ratios to their correct values by means of the coefficients A1 . . . A4. The use of the parallel model is a rather straightforward approximation procedure and no particularly strong mathematical background is associated with it.

In contrast, the method by which the cascade model is created is more distinctly based on mathematical analysis (see /3/, p. 214-). When the load of a low-loss acoustic tube is represented by a short circuit, Equation (1) obtains the form $$H_A(s) = \frac{1}{\cosh y(s)l} \tag{3}$$

Applying here the series expansion derived for functions of complex variables converts the expression to $$\frac{1}{\cosh y(s)\,l} = \prod_{n=1}^{\alpha} \frac{\omega_n^2}{(s - s_n)(s - s_n^*)} \tag{4}$$

where $s_n$=first zero of the function cosh (s)

$s_n^*$=the complex conjugate of the above $\omega_n$=the resonance frequency corresponding to the $n^{th}$ zero of cosh y (s)l .

According to Equation (4), the acoustic transfer function of the sound channel, which comprises an infinite number of equal bandwidth resonances at uniform intervals on the frequency scale (see FIG. 7), can be written as a product of rational expressions. Each rational expression represents the transfer function of a second order low-pass filter with resonance. The desired transfer function may thus in principle be produced by connecting in cascade an infinite group of low-pass filters of the type mentioned. In practice, as known in the art, three to four lowest resonances are taken into account, and the influences of higher formants on the lower frequencies are then approximated by means of a derivating correction factor (correction of higher poles, see /2/ p. 50-51). The correction factor calculated from the series expansion is graphically shown in FIG. 1D (curve a). The overall transfer function of the cascade model with its correction factor is shown as curve b in the same FIG. 1D. The curve c in FIG. 1D illustrates the error of the model, compared with the acoustic transfer function. The error of approximation is exceedingly small in the range of the formants included in the model.

In actual truth when speech is being formed, the profile of the sound channel and its transfer function are varied in large extent. It is important from the viewpoint of speech synthesis that the terminal analog that is used is able to model acoustic phenomena in any phases and variations of speech. In addition to the difficulties already described, the cascade-connected model of prior art has presented problems in the modelling of the sound channel's transfer functions. In cases of an inhomogeneous channel, which constitute the greater part of situations occurring in real speech, the use of cascade model may lead to errors in the amplitudes of the formants. With a view to Vocoder applications, attempts have been made to eliminate this problem by a patented design based on afterward correction of the spectrum /5/ G. Fant: Vocoder System, U.S. Pat. No. 3,346,695, Oct. 10, 1967. Particularly controversial requirements are imposed by the tone balancing of front and back vowels.

Figure 1E:
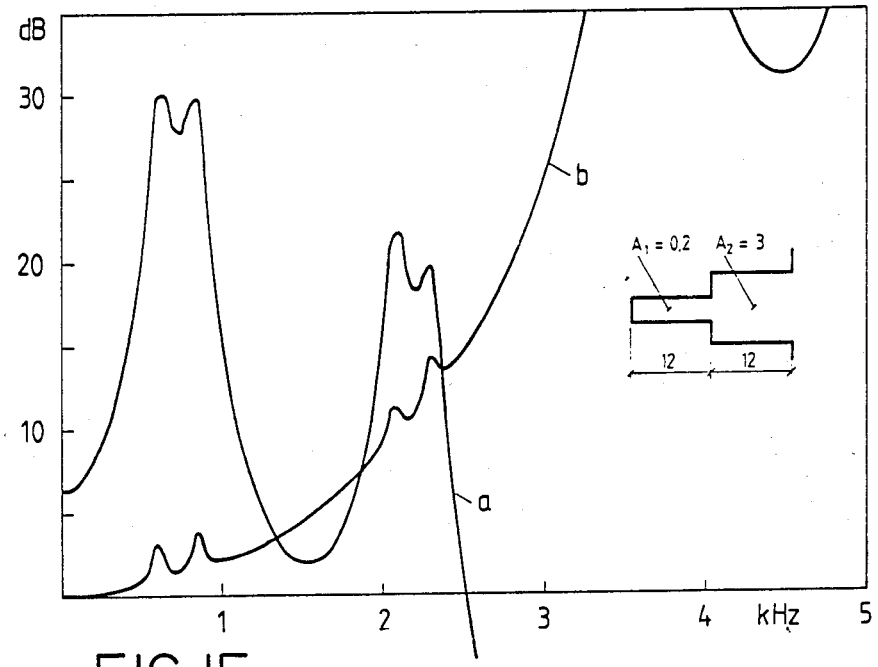
Figure 1F:
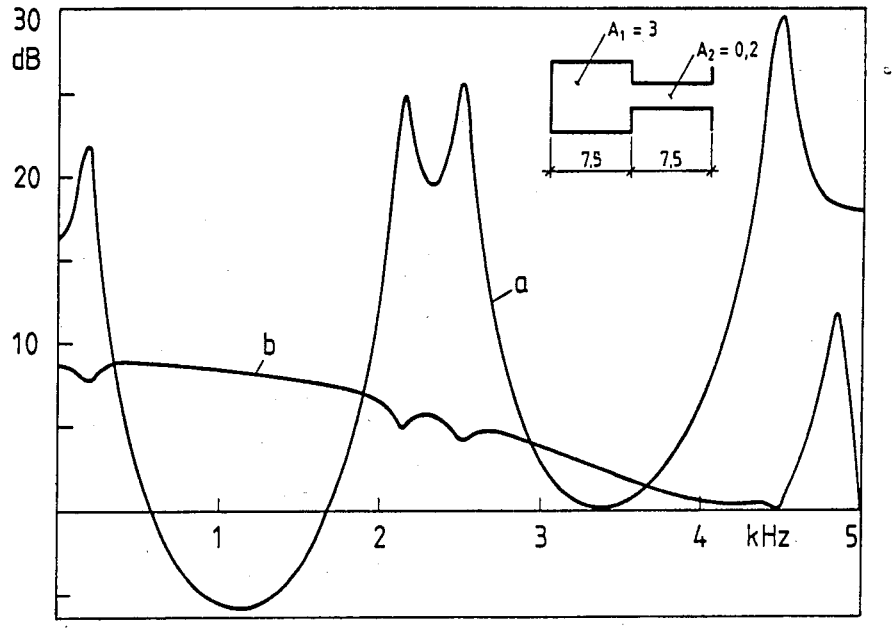

The problem touched upon in the foregoing is illustrated in FIGS. 1E and 1F by computer simulations. In the simulations, the acoustic sound channel has been modelled with two low-loss homogeneous tubes with different cross sections and length (cf. /3/, p. 69-72). The cascade model has been adapted to the acoustic transfer function of this inhomogeneous channel so that the formant frequencies and Q values are the same as in the acoustic transfer function. The transfer function of the cascade model is shown as curves a in the figure and the error incurred, as curves b. FIG. 1E represents in the first place a back vowel /o/ and FIG. 1F, a front vowel /e/.

FIGS. 1E and 1F reveal that the cascade model causes a quite considerable error in front as well as back vowels. The errors are moreover different in type, and this makes their compensation more difficult.

In the foregoing, the most generally known methods for the modelling of speech production have been reviewed. These considerations may be summarized by observing that the following problems are encountered in the models of prior art, the solving of which, in part at least, is one of the objects of the present invention.

Cascade models (FIG. 1A):

not applicable as such in the synthesis of fricatives, nor of several other consonant sounds giving rise to problems of dynamics causing errors in the amplitude relations even of vowel sounds; a particular problem being that of finding a tone balance between front and back vowels.

Parallel model (FIG. 1B):

a large group of control parameters required the values of the amplitude parameters are difficult to generate by regular synthesis the model fails to realize the cascade principle of the sound channel.

Combination models (Klatt) (FIG. 1C):

regarding the parallel and cascade branches, the problems are in principle the same as in the equivalent parallel and cascade models, but said branches complement each other so that many of the problems are avoidable thanks to the parallel arrangement of two branches of different type structural complexity and difficult control of parameters.

LPC synthesis:

the filter parameters are difficult to generate by regular synthesis problems associated with the speech production model employed by LPC synthesis, which impair the quality of the synthetic sound (cf. e.g. D.Y. Wong: On Understanding the Quality Problems of LPC Speech, ICASSP 80, Denver, Proc., p. 725–728).

The sound channel models produced by the method of the invention are also applicable in speech analysis and speech recognition, where the estimation of the speech signals' features and parameters plays a central role.

Such parameters are, for instance, the formant frequencies, the formants' Q values, amplitude proportions, voiced/unvoiced quality, and the fundamental frequency of voiced sounds. Usually the Fourier transformation is applied to this purpose, or the estimation theory, which is known from the field of control technology in the first place. Linear prediction is one of the estimation methods.

Figure 1G:
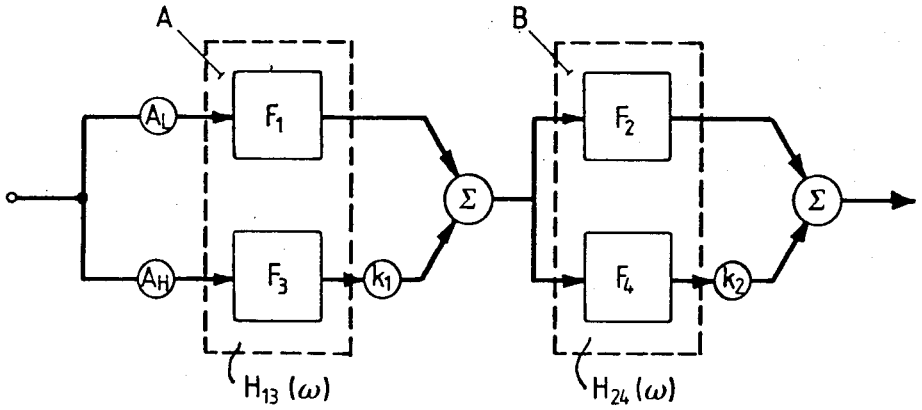
FIG. 1G is a block diagram of a parallel-cascade (PARCAS) model of the invention.

FIG. 1G shows a typical PARCAS model created as taught by the invention. It is immediately apparent from FIG. 1G that the PARCAS model realizes the cascade principle of the sound channel, that is, adjacent formants (the blocks F1 . . . F4) are still in cascade with each other (F1 and F2, F2 and F3, F3 and F4, and so on). Simultaneously the model of FIG. 1G also implements the property of parallel models that the lower and higher frequency components of the signal can be handled independent of each other with the aid of adjusting the parameters $A_L$, $A_H$, $k_1$, $k_2$. This renders possible the parallel formant circuits F1,F3 and F2,F4 in the filter elements A and B. As a result of this structural feature, the PARCAS model of FIG. 1G is suitable to be used in the synthesis not only of sonant sounds, but very well also in that e.g. of fricatives, both voiced and unvoiced, as well as transient-type effects. For instance, the fifth formant circuit potentially required for the s sound may be connected either in parallel with block A in FIG. 1G or in cascade with the whole filter system. The 250 Hz formant circuit required by nasals may also be adjoined to the basic structure in a number of ways. Thanks to the parallel structures of blocks A and B in FIG. 1G, it is possible with the PARCAS model to achieve signal dynamics on a level with the parallel model, and a good signal/noise ratio. For the same reason, the model is also advantageous from the viewpoint of purely digital realization.

In the following the analytical foundation of the model of the invention shall be considered in detail.

In the transfer function of Equation (2) the amplitude coefficient A may be omitted in the subsequent consideration, whereby the transfer function appears in the form $$H_A(\omega) = \frac{1}{\cos x + j\,a \sin x} \tag{5}$$

where a is a real coefficient ($a<1$) depending on the losses of the channel and/or its acoustical load, and $x=k\omega$. The expression in Equation (5) can be exactly written as the product of two partial functions, as follows:

$$\frac{1}{\cos x + j\,a \sin x} = \tag{6}$$

-continued $$\frac{1}{(b \cos x_- + j\,c \sin x_-)(b \cos x_+ + j\,c \sin x_+)}$$

where $x_- = (x - \pi/2)/2$ $x_+ = (x + \pi/2)/2$ $$b = (\sqrt{1+a} + \sqrt{1-a})/\sqrt{2}$$

$$c = (\sqrt{1+a} - \sqrt{1-a})/\sqrt{2}$$

The partial transfer functions of Equation (6) may also be written in the form $$\frac{1}{b \cos x_\pm + j\,c \sin x_\pm} = \frac{b'}{\cos x_\pm + j\,a' \sin x_\pm} \tag{7}$$

where $$a' = (1 - \sqrt{1-a^2})/a$$

$$b' = 1/b = c/a = (\sqrt{1+a} - \sqrt{1-a})/(a\sqrt{2})$$

Equations (6) and (7) show that the original transfer function (2) can be decomposed into two partial transfer functions, which are in principle of the same type as the original function. However, only every second resonance of the original function occurs in each partial transfer function.

In the analysis just presented, the original acoustic transfer function was decomposed into two parts. By applying the same procedure, again, to the parts, both parts can be further decomposed into partial transfer functions with fewer resonances.

Figure 7:
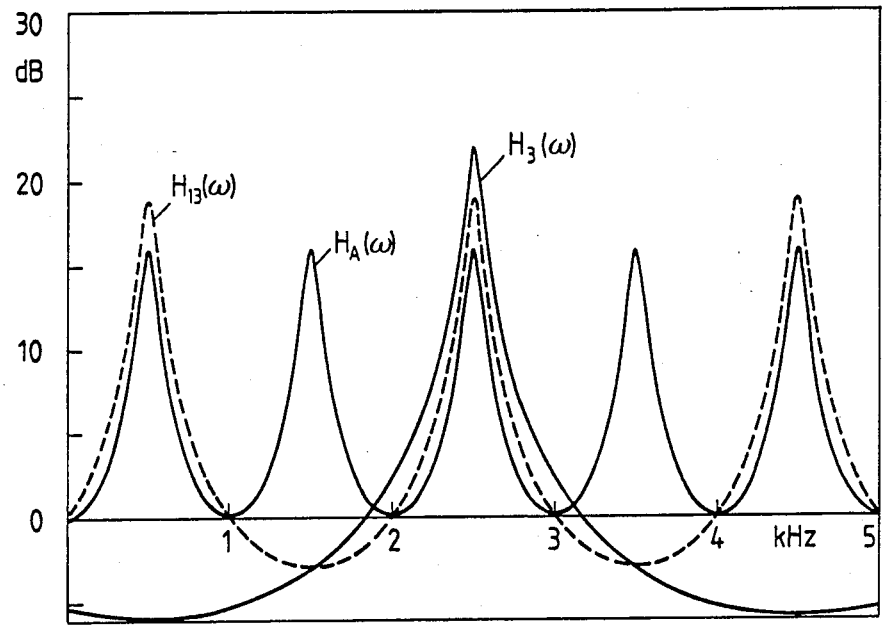
FIGS. 7 to 13 are various amplitude graphs, plotted against time, obtained by computer simulation, illustrating the advantages of the model of the invention over the prior art.

FIG. 7 graphically presents the original acoustic transfer function $H_A(\omega)$ in the case of $B_i = 100$ Hz (constant bandwidths). The function $H_{13}(\omega)$ represents one of the two partial transfer functions obtained by the first decomposition, and $H_3(\omega)$ represents the transfer function obtained by further decomposition of the latter. The partial transfer function $H_{24}(\omega)$ has the same shape as $H_{13}(\omega)$, with the formant peaks located at the second and fourth formants. The partial transfer functions $H_1(\omega)$, $H_2(\omega)$ and $H_4(\omega)$, respectively, are obtained by shifting the $H_3(\omega)$ graph along the frequency axis.

The original acoustic transfer function can be decomposed according to similar principles also into three, four, etc., instead of two, mutually similar partial transfer functions. However, decomposition into two parts is the most practical choice, considering channel models composed of four formants.

When Equation (6) is once applied to Equation (2), the result is a PARCAS structure as shown in FIG. 1G. On repeated application of Equation (6) on the partial transfer functions $H_{13}$ and $H_{24}$, the outcome is a model with pure cascade connection, where the transfer function of every formant circuit is, or should be, of the form $H_3$. It is thus also possible by the modelling method of the invention to create a model with pure cascade connection. Differing from prior art, the formants of this new model are closer to the band-pass than to the low-pass type. If one succeeds in approximating the transfer functions of the $H_3$ type with sufficient accuracy, no spectral-correction extra filters are required in the model. The dynamics of the filter entity have at the same time improved considerably, compared, for example, with the cascade model of the prior art (FIG. 1A).

Generally speaking, the principle just described may be applied to decompose the acoustic transfer function $H_A$ of a homogeneous sound channel according to Equation (5) into n partial transfer functions, in which every n-th formant of the original transfer function is present, and by the cascade connection of which exactly the original transfer function $H_A$ is reproduced. The following table shows the kinds of partial transfer functions obtained in the special cases n=2 and n=3, and in the general case. Table I also reveals which formants belong to which partial transfer function.

TABLE I

| | |
|---|---|
| n = 2 | |
| $H_A$: | $H_{13} \triangleq F_1, F_3, F_5, \ldots$ |
| | $H_{24} \triangleq F_2, F_4, F_6, \ldots$ |
| n = 3 | |
| $H_A$: | $H_{14} \triangleq F_1, F_4, F_7, \ldots$ |
| | $H_{25} \triangleq F_2, F_5, F_8, \ldots$ |
| | $H_{36} \triangleq F_3, F_6, F_9, \ldots$ |
| General form: | |
| $H_A$: | $H_{1(n+1)} \triangleq F_1, F_{(n+1)}, F_{(2n+1)}, \ldots$ |
| | $H_{2(n+2)} \triangleq F_2, F_{(n+2)}, F_{(2n+2)}, \ldots$ |
| | ... |
| | $H_{n(2n)} \triangleq F_n, F_{2n}, F_{3n}, \ldots$ |

Equation (5) is also decomposible into two transfer functions, the original function being obtained as their sum.

$$\frac{1}{\cos x + j\,a \sin x} = \frac{1}{b-c}\left[\frac{\cos x_- + j \sin x_-}{b \cos x_+ + j\,c \sin x_+} + \frac{\cos x_+ + j \sin x_+}{b \cos x_- + j\,c \sin x_-}\right] \quad (8)$$

where $x_{31}$, $x_+$, b and c are as in Equation (6).

The transfer functions obtained differ from those presented in Equation (6) only by the phase factors in the numerator. By applying Equation (8) first to Equation (2) and thereafter to the partial functions which have been obtained, a parallel model is produced, in which the transfer functions of the individual formant circuits have the form $H_3$. Equation (8) may equally be applied in the division of partial transfer functions $H_{13}$ and $H_{24}$ into parallel elements $H_1$ and $H_2$. A more precise picture can thus be obtained of how the lower and upper formants should be approximated and how the phase relations should be arranged for the combined transfer function constituting the objective to be produced.

It is obvious that it is difficult to find an accurate, and at the same time simple, polynomial approximation for a function of the $H_3$ type. The amplitude graph of an acoustic resonance is symmetrical on a linear frequency scale, which is not true for most of the simple transfer functions of second order filters. This accuracy requirement is essential in the pure cascade model, whereas the pure parallel model is not critical in this respect.

Figure 3:
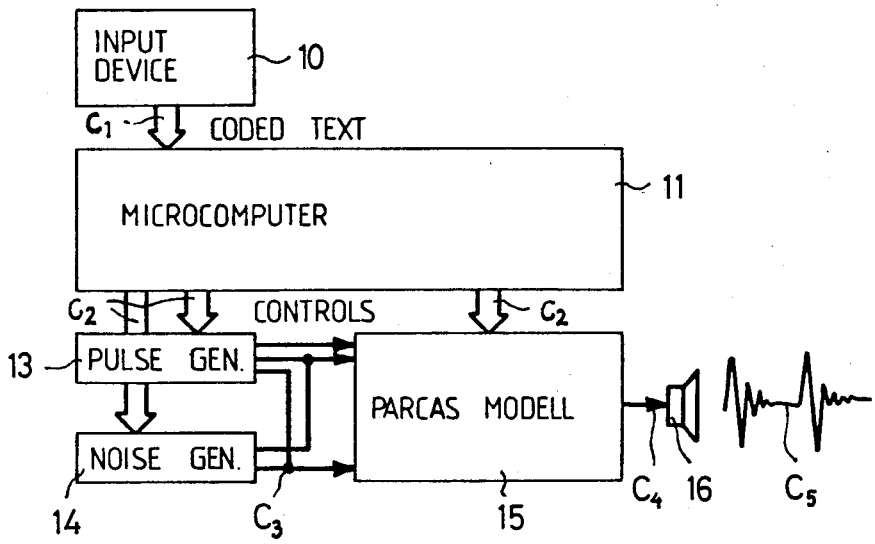
FIG. 3 is a block diagram of a speech synthesizer applying a model of the invention.

Sound channel models obtained by the method of the invention may be applied, for example, in speech synthesizers, for example, in the manner shown in FIG. 3. Over the input device 10, the text C1 to be synthesized (coded text), converted into electrical form, is supplied to the microcomputer 11. The part of the input device 10 may be played either by an alphanumeric keyboard or by a more extensive data processing system. The coded text C1 transmitted by the input device 10 goes in the form of series or parallel mode signals through the input circuits of the microcomputer 11 to its temporary memory (RAM). The control signals C2 are obtained from the microcomputer 11 and control both the pulse generator 13 and the noise generator 14, the latter being connected by interfaces C3 to the PARCAS model 15 of the invention. The output signal C4 from the PARCAS model is an electrical speech signal, which is converted by the loudspeaker 16 to an acoustic signal C5.

Figure 4:
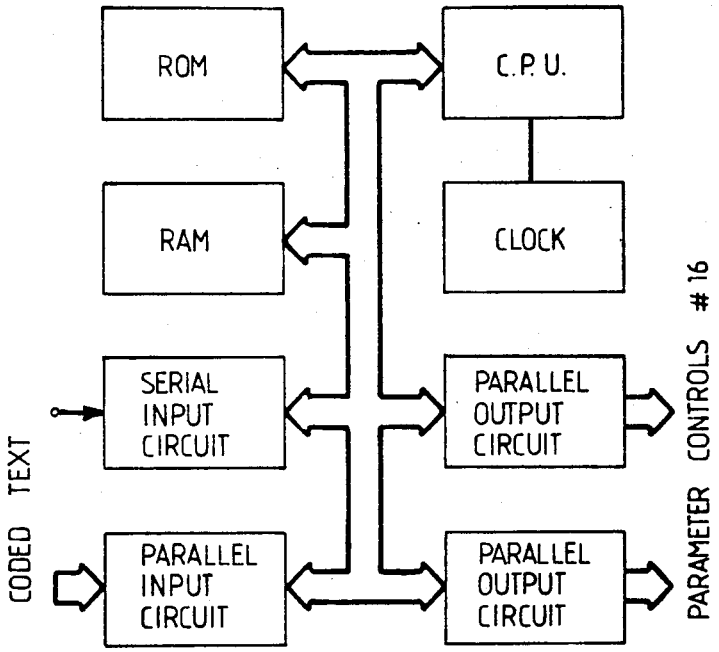
FIG. 4 is a block diagram of a more detailed embodiment of the speech synthesizer of FIG. 3 and the communication between its different units.

The microprocessor 11 consists of a plurality of integrated circuits of the type shown in FIG. 4, or of one integrated circuit comprising such units. Communication between the units is over data, address and control buses. The arithmetic-logical unit (C.P.U.) of the microcomputer 11 operates in the manner prescribed by the program stored in the permanent memory (ROM). The processor reads from the inputs the text that has been entered and stores it in the temporary memory (RAM). On completed storing of the text to be synthesized, the regular system program starts to run. It analyzes the stored text and sets up tables and, using the set of rules, controls for the terminal analog, which consists of the pulse and noise generator 13,14 and of the sound channel model 15 of the invention.

Figure 5:
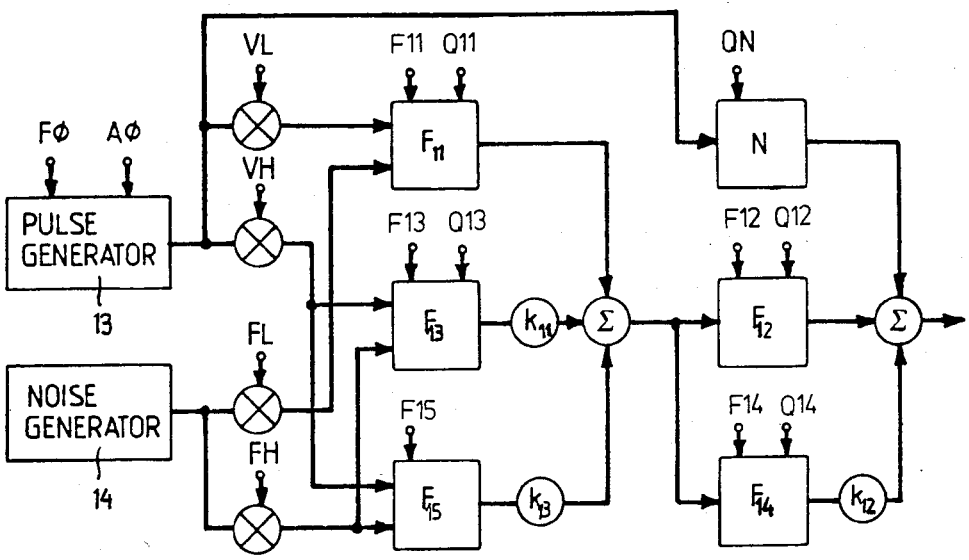
FIG. 5 is a block diagram of a more detailed embodiment of a terminal analog based on a PARCAS model of the invention.

The more detailed structure of the terminal analog based on the PARCAS model is shown in FIG. 5. In the case of voiced sounds, the pulse generator 13 operates as the main signal source, its frequency of oscillation $F\phi$ and amplitude $A\phi$ being separately controllable. In the case of fricative sounds, the noise generator 14 serves as the source. In the case of voiced fricatives, both signal sources 13 and 14 are in operation simultaneously. The pulses from the sources are fed into three parallel-connected filters $F_{11}$, $F_{13}$ and $F_{15}$ over amplitude controls. The amplitudes of the higher and lower frequencies in the spectra of both sonant and fricative sounds are separately controllable by the controls VL, VH and FL, FH respectively. The signals obtained from the filters $F_{11}$, $F_{13}$ and $F_{15}$ are added up. Either before this summing operation or in its connection, the signal from the filter $F_{13}$ is attenuated by the factor $k_{11}$ and that from filter $F_{15}$ by the factor $k_{13}$. The summed signal from filters $F_{11} \ldots F_{15}$ is carried to the filters $F_{12}$ and $F_{14}$. In parallel with the filters mentioned has been connected a nasal resonator N (resonance frequency 250 Hz). The output of the nasal resonator N is summed with the signals from filters $F_{12}$ and $F_{14}$, while at the same time the signal component that has passed through the filter $F_{14}$ is attenuated by the factor $k_{12}$. The other parameters of the terminal analog include the Q values of the formants (Q11, Q12, Q13, Q14, QN). The output signal can be made to correspond to the desired sounds by suitably controlling the parameters of the terminal analog.

Figure 6:
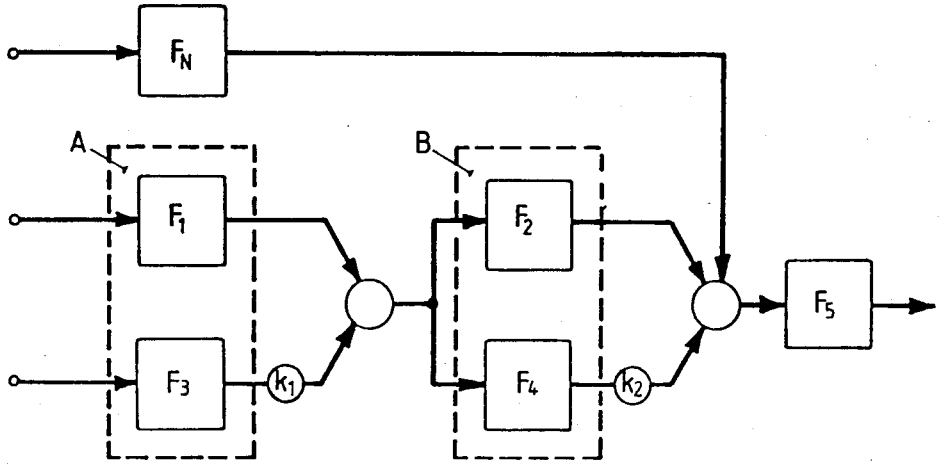
FIG. 6 is a block diagram of an alternative embodiment of the model of the invention.

The terminal analog of FIG. 5 represents one of the realisations of the PARCAS principle of the invention. The same basic design may be modified, for example, by altering the position of the formant circuits $F_{15}$ and N. FIG. 6 presents one such variant.

It could be established both by computer simulation runs and in practical laboratory tests that it is possible by the PARCAS model of the invention to attain a higher accuracy in the approximation of the transfer function than by any other designs. This is mainly due to the internal structures of the filter elements A and B (FIG. 6). If it is desired, for example, to construct a pure cascade model of transfer functions of $H_3$ type (FIG. 7), such a transfer function should be approximable accurately within the whole frequency band under consideration. But this is found to be difficult in practice.

Figure 2:
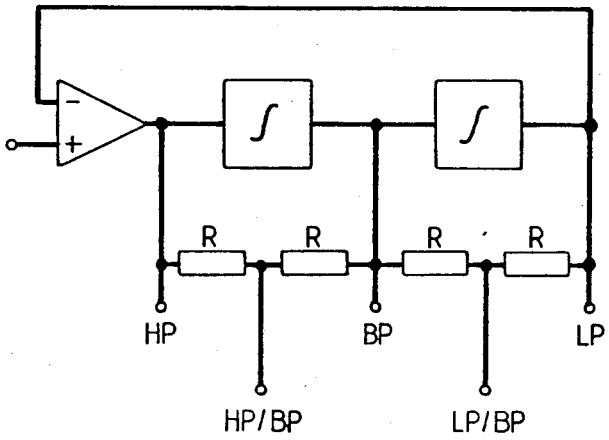
FIG. 2 is a block diagram of an embodiment of a single formant circuit of the invention by a combination of transfer functions of low, high and band-pass filters.
Figure 8:
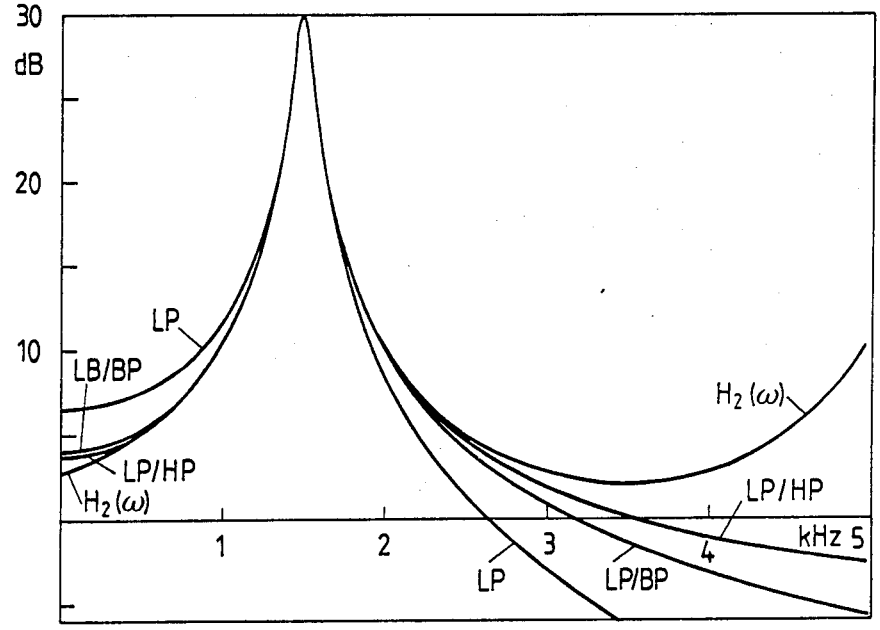

FIG. 2 illustrates the approximation of $H_2$ by means of a low-pass filter LP, a low-pass and band-pass filter combination LP/BP and a low-pass and high-pass filter combination LP/HP. The filters can be realized, for example, by the filter principle shown in FIG. 2. In the embodiment of FIG. 8, the low-pass approximation introduces the largest and the LP/HP combination the smallest error. The error of approximation is high at the top end of the frequency band in all instances.

Figure 9:
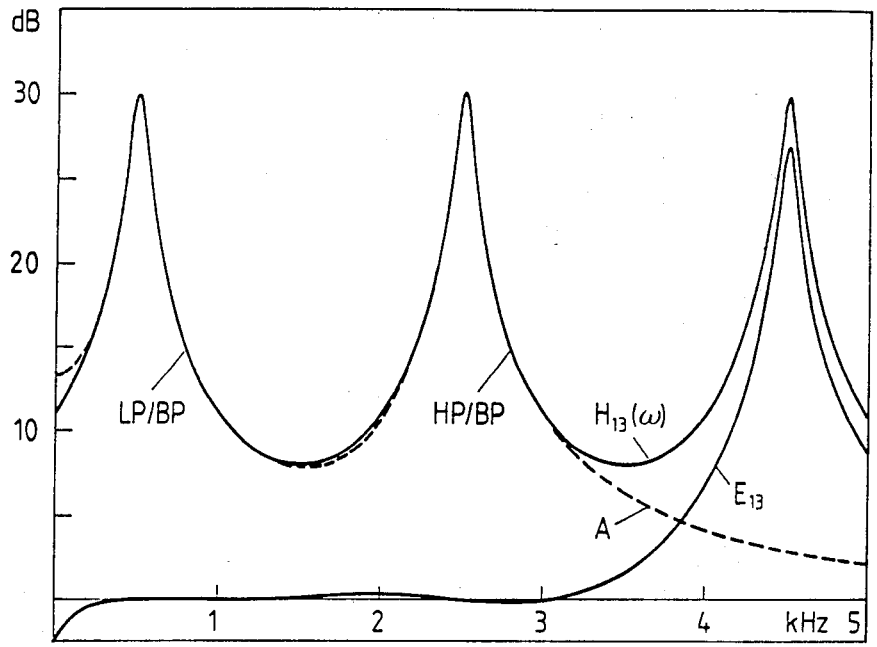
Figure 10:
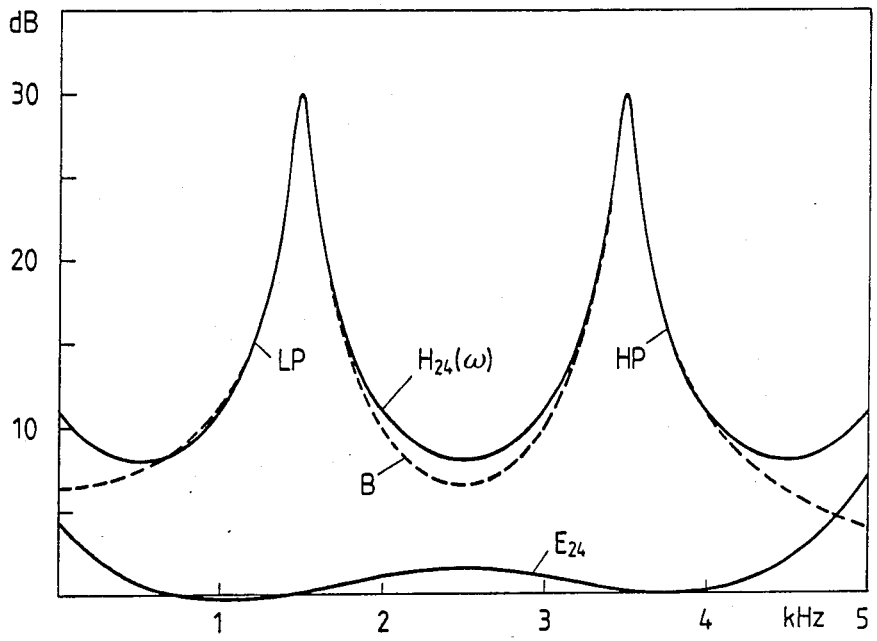

In PARCAS models, where the transfer functions to be approximated are of the form $H_{13}$ (FIG. 9), it is possible to make the error of approximation very small over a wide band. In FIG. 9, $H_{13}$ has been approximated with the parallel connection of LP/BP and HP/BP filters, and it is observed that the error $E_{13}$ is exceedingly small on the central frequency band. FIG. 10 shows the approximation of $H_{24}$ by low-pass and high-pass filters alone. The error $E_{24}$ is small on the average here, too.

Figure 11:
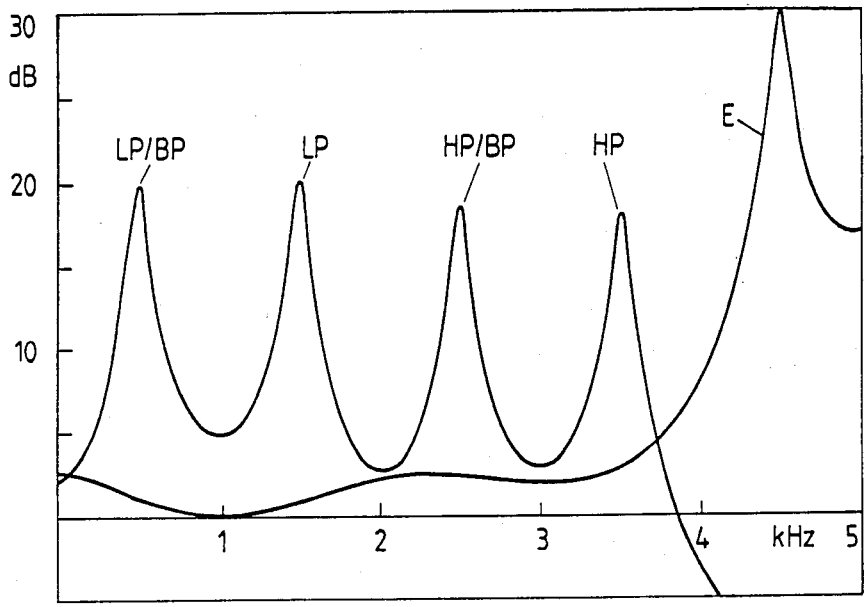

FIG. 11 displays the overall transfer function of the PARCAS model consistent with the principles of the invention obtained as the combined result of approximations as in FIGS. 9 and 10, and the error E compared with the acoustic transfer function. The coefficients of the model (see FIG. 1G) are in this case $k_1=-0.2$, $k_2=0.43$ and $A_L=A_H$. The values of the coefficients $k_i$ represent the case of a neutral vowel. In the inhomogeneous case, the coefficients have to be adjusted consistent with the formants' Q values as follows:

$$k_1=Q_1/Q_3 \; k_2=Q_2/Q_4. \tag{9}$$

If the band widths are constant, for example, Bi=100 Hz, the coefficients may be defined directly from the resonance frequencies:

$$k_1=F_1/F_3 \; k_2=F_2/F_4. \tag{10}$$

Figure 12:
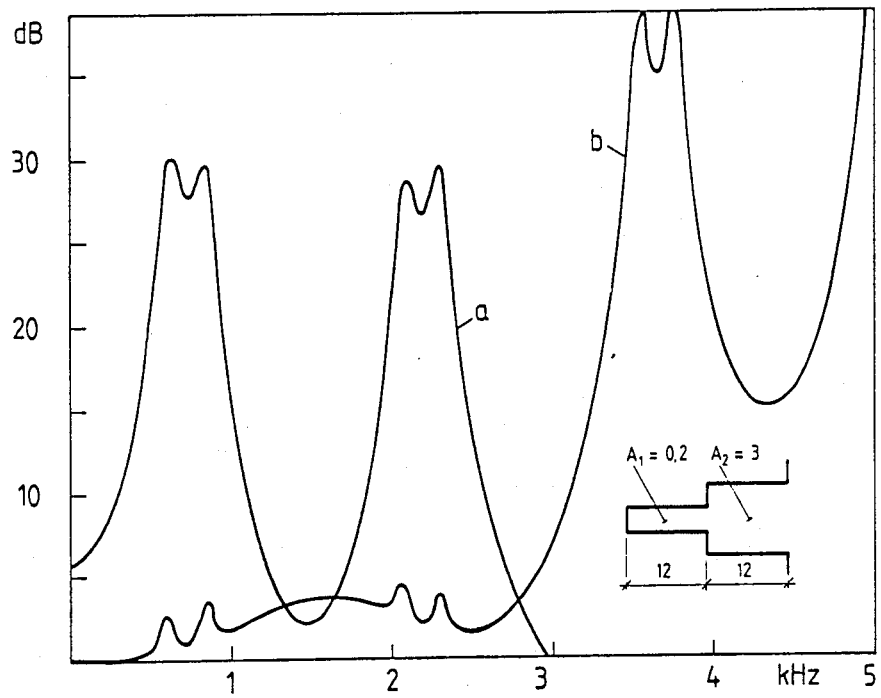
Figure 13:
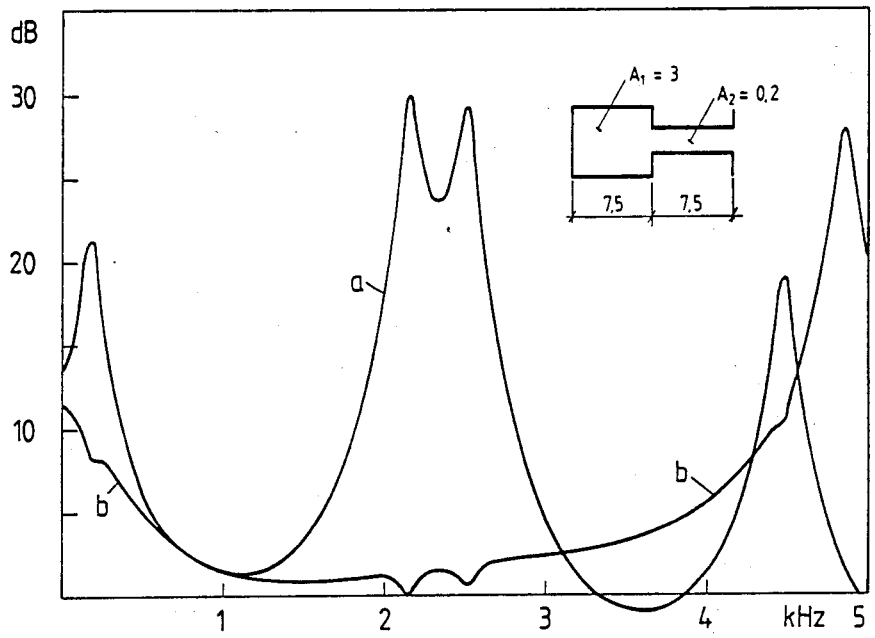

By adjusting the coefficients $k_i$ as indicated by Equation (10), higher accuracy is achieved with the PARCAS model in all vowel sounds. In FIGS. 12 and 13, this principle has been followed in simulating the vowels /o/ and /i/, and it is seen that the error of approximation remains, in these non-homogeneous channel cases, in the most central frequency range significantly smaller than with the cascade model (cf. FIGS. E and F).

The example presented above shows that the PARCAS design according to the present invention eliminates many of the cascade model's problems. At the same time, the model of the invention is substantially simpler than the cascade model of the prior art, for example, because it requires no corrective filter, and furthermore it is more accurate in cases of inhomogeneous sound channel profiles.

As was observed earlier in the introductory part of the disclosure, the invention may also be applied in connection with speech recognition. The models created by the method of this invention have been found to be simple and accurate models of the acoustic sound channel. It is therefore obvious that the use of these models is advantageous also in estimation of the parameters of a speech signal. Therefore, the use of models produced by the method above described in speech recognition, in the process of estimating its parameters, is also within the protective scope of this invention.

Furthermore, by using Equation (6) repeatedly (without limit, the transfer function representing one single (ideal) acoustic resonance can be produced. This transfer function too, and its polynomial approximation, has its uses in the estimation of a speech signal's parameters, in the first place of its formant frequencies. The formant frequencies are effectively identifiable by applying the ideal resonance to the spectrum of a speech signal. Therefore, the use of the ideal formant in speech signal analysis is also within the protective scope of this invention.

In the following are stated the claims, different details of the invention being allowed to vary within the scope of the invention idea defined by these claims.

I claim:

1. An electronic filter system modelling an acoustic sound channel conforming to a human phonation system or to a music instrument, said filter system comprising filter elements, each having a rational function approximating a partial transfer function Hij computed by decomposing the acoustic transfer function of a homogeneous sound channel $$H_A = \frac{1}{\cos x + ja \sin x}$$

into n partial transfer functions Hij (i=1 . . . n,j=n+1 . . . 2n) comprising only the ith, (i+n)th, (i+2n)th, . . . format of $H_A$, said filter elements comprising formant circuits; and connecting means connecting said formant circuits in a manner whereby formant circuits with formants mutually adjacent in frequency are in cascade with each other.

2. An electronic filter system as claimed in claim 1, wherein said system is used in speech identification.

3. An electronic filter system: as claimed in claim 1, wherein said system is used to estimate the parameters of a speech signal.

4. An electronic filter system as claimed in claim 1, wherein said system is used as a sound channel of a speech synthesizer.

5. An electronic filter system as claimed in claim 1, wherein said connecting means connect the remaining formant circuits in parallel and the weight factors of said formant circuits connected in parallel are constant when the output amplitudes of said formant circuits connected in parallel are summed.

6. An electronic filter system as claimed in claim 5, wherein said parallel-cascade circuit provides a model of the order n=2 and wherein a filter element of said system has a transfer function approximated by a low-pass filter and a high-pass filter, and another filter element of said system has a transfer function approximated by a low-pass and band-pass filter combination and a high-pass and band-pass filter combination.

7. An electronic filter system as claimed in claim 6, further comprising input means for supplying input signals to said other filter element, and amplitude control means for controlling the amplitudes of said input signals independently from each other.

8. A speech synthesizer, comprising input means;

a microcomputer connected to said input means, said microcomputer having a temporary random access memory, a central processing unit and a permanent readout memory having a program stored therein, said central processing unit operating in a manner prescribed by said program stored in said permanent readout memory, said input device supplying to said microcomputer a coded text to be synthesized and said text passing through said input means in the form of series or parallel mode signals to said temporary memory of said microcomputer, said microcomputer reading said text and storing said text in said temporary memory, and after completion of the storing of the string of symbols to be synthesized, starting a control synthesis program which analyzes the stored text and sets up tables, and uses sets of rules to provide control signals;

a pulse generator connected to said microcomputer;

a noise generator connected to said pulse generator;

an electronic filter system connected to said microcomputer, said pulse generator and said noise generator for modelling an acoustic sound channel, said pulse generator, said noise generator and said electronic filter system comprising a terminal analog, and said control signals provided by said microcomputer being supplied to said terminal analog, and said electronic filter system comprising electrical filter elements each having a rational transfer function approximating a partial transfer function Hij computed by decomposing the acoustic transfer function of a homogeneous sound channel $$H_A = \frac{1}{\cos x + ja \sin x}$$

into n partial transfer functions Hij (i=1 . . . n,j=n+1 . . . 2n) comprising only the ith, (i+n)th, (i+2n)th . . . formant of $H_A$, said filter elements having formant circuits, and connecting means connecting said formant circuits in a manner whereby formant circuits with formants mutually adjacent in frequency are in cascade with each other; and transducer means connected to said electronic filter system for converting electrical signals to acoustic signals.

9. A speech synthesizer as claimed in claim 8, wherein said pulse generator functions primarily as a signal source of voice sounds, said pulse generator having a frequency of oscillation and a pulse amplitude separately controlled, said noise generator functioning primarily as a signal source of fricative sounds, and both said pulse generator and said noise generator functioning simultaneously primarily as a signal source of voice fricatives.

10. A speech synthesizer as claimed in claim 9, further comprising three parallel-connected filters, amplitude control means, pulses from said signal sources being supplied to said three filters via said amplitude control means in a manner whereby the signals from said filters are summed, first attenuating means connected to one of said filters for attenuating the signal from said one of said filters by a first predetermined factor, either before or after the summing, second attenuating means connected to a second of said filters for attenuating the signal from said second of said filters by a second predetermined factor, two additional filters, the summed signal from said three filters being supplied in parallel to said two additional filters, a nasal resonance filter connected in parallel with all said filters, said nasal resonance filter providing an output summed with the signals from said two additional filters, and additional attenuating means connected to one of said two additional filters for attenuating the signal from said one of said two additional filters by a third predetermined factor.

11. A speech synthesizer as claimed in claim 10, wherein said formants have Q values used as additional signals for said terminal analog.

* * * * *